United States Patent [19]

Yokoyama et al.

[11] Patent Number: 4,808,107

[45] Date of Patent: Feb. 28, 1989

[54] PULSE COMBUSTION SYSTEM

[75] Inventors: Nobuyoshi Yokoyama; Yoshihiro Matsumura, both of Nagoya, Japan

[73] Assignee: Paloma Kogyo Kabushik Kaisha, Nagoya, Japan

[21] Appl. No.: 47,301

[22] Filed: May 5, 1987

[51] Int. Cl.[4] ..... F23C 11/04

[52] U.S. Cl. ..... 431/1

[58] Field of Search ..... 431/1

[56] References Cited

U.S. PATENT DOCUMENTS 2,816,605 12/1957 Seville ..... 431/14
3,119,436 1/1964 Rydberg ..... 431/1
3,469,929 9/1969 Haag ..... 431/1

FOREIGN PATENT DOCUMENTS 59-74410 4/1984 Japan ..... 431/1

*Primary Examiner*—Carroll B. Dority, Jr.

*Attorney, Agent, or Firm*—Berman, Aisenberg & Platt

[57] ABSTRACT

A pulse combustion system in which a single air intake assembly is associated with a plurality of pulse combustion gaseous fuel heater assemblies. The air intake assembly includes a blower arranged to supply combustion air to the heater assemblies, and the heater assemblies each includes a pulse combustion burner arranged to be supplied with gaseous fuel from a source of gaseous fuel and the combustion air from the blower. A tailpipe is connected to the combustion chamber of the burner and arranged therewith within a water tub or an oil vessel. An electric control appartus for the system selectively activates the heater assemblies, energizes a motor of the blower for a predetermined period of time prior to selective activation of the heater assemblies and energizes the motor of the blower for a second predetermined period of time after one of the heater assemblies has been deactivated during activation of the other heater assemblies.

6 Claims, 1 Drawing Sheet

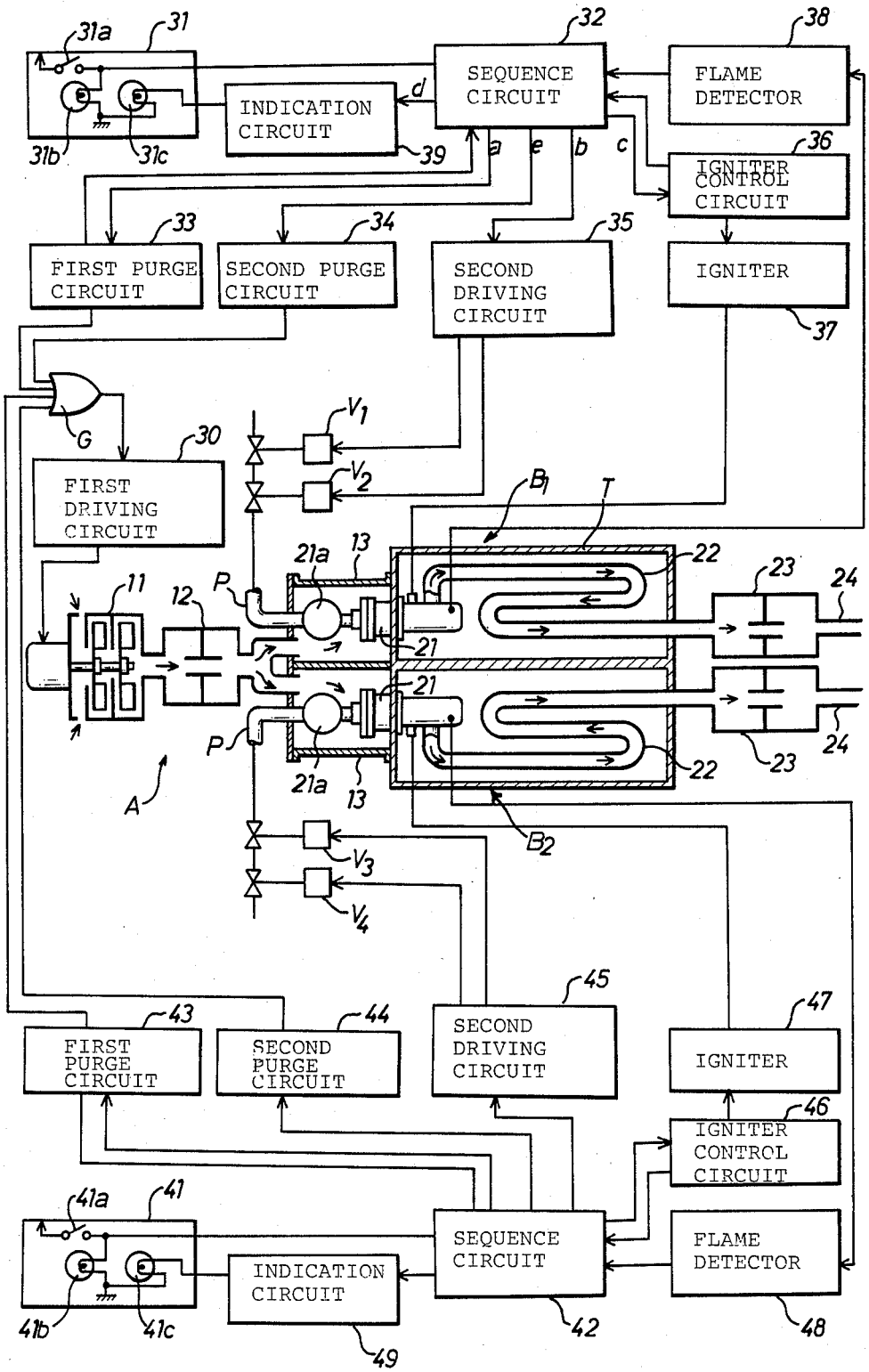
31a
31
31b
31c
INDICATION CIRCUIT
39
d
32
SEQUENCE CIRCUIT
38
FLAME DETECTOR
a
e
b
c
36
IGNITER CONTROL CIRCUIT
33
FIRST PURGE CIRCUIT
34
SECOND PURGE CIRCUIT
35
SECOND DRIVING CIRCUIT
IGNITER
37
G
30
FIRST DRIVING CIRCUIT
V1
V2
B1
T
21a
13
22
23
24
11
12
P
21
1
A
B2
V3
V4
45
43
FIRST PURGE CIRCUIT
44
SECOND PURGE CIRCUIT
SECOND DRIVING CIRCUIT
47
IGNITER
46
IGNITER CONTROL CIRCUIT
41a
41
41b
41c
SEQUENCE CIRCUIT
FLAME DETECTOR
INDICATION CIRCUIT
42
48
49

PULSE COMBUSTION SYSTEM

BACKGROUND OF THE INVENTION

1. Field of the Invention

The present invention relates to a pulse combustion system adapted to heater units such as a storage water heater for professional use.

2. Description of the Prior Art

In such a conventional pulse combustion system as described above, an air intake assembly is associated with a pulse combustion gaseous fuel heater assembly to supply combustion air to the heater assembly. The air intake assembly includes a blower, an air induction muffler and an air chamber which are connected in series, while the heater assembly includes a gas chamber, a pulse combustion burner, a tailpipe, an exhaust muffler and an exhaust pipe which are connected in series. The combustion chamber of the burner and the tailpipe are disposed in a water tub or an oil vessel to effect heat exchange between the water or oil and combustion products from the burner. In the pulse combustion system, it is difficult to increase heating capacity of the burning by adjustment of the combustion amount of the air-gas mixture. For this reason, there has been proposed a pulse combustion system wherein a plurality of air intake assemblies are arranged in parallel and associated with a plurality of pulse combustion gaseous fuel heater assemblies to adjust heating capacity of the system by selective activation of the heater assemblies. Such a pulse combustion system is, however, large in size and complicated in construction due to the provision of the parallel intake assemblies.

SUMMARY OF THE INVENTION

It is, therefore, a primary object of the present invention to provide a pulse combustion system wherein a single air intake assembly is associated with a plurality of pulse combustion gaseous fuel heater assemblies in a simple construction to adjust the heating capacity of the system by selective activation of the heater assemblies and to purge exhaust gases from the deactivated heater assembly.

According to the present invention, a pulse combustion system includes a single air intake assembly associated with a plurality of pulse combustion gaseous fuel heater assemblies. The air intake assembly includes a blower arranged to supply combustion air to the heater assemblies, and the heater assemblies each include a pulse combustion burner arranged to be supplied with gaseous fuel from a source of gaseous fuel and the combustion air from the blower. A tailpipe is connected to the combustion chamber of the burner and is arranged therewith within a water tub or an oil vessel. An electric control apparatus for the pulse combustion system comprises means for selectively activating the heater assemblies and for energizing a motor of the blower for a predetermined period of time prior to selective activation of the heater assemblies. and means for energizing the motor of the blower for a second predetermined period of time when one of the heater assemblies is deactivated during activation of the other heater assemblies.

BRIEF DESCRIPTION OF THE DRAWING

Additional objects, features and advantages of the present invention will be readily appreciated from the following detailed description of a preferred embodiment thereof when considered with reference to the accompanying drawing, in which the single FIGURE illustrates a pulse combustion system in accordance with the present invention and an electric control apparatus for the system.

DESCRIPTION OF THE PREFERRED EMBODIMENT

Referring now to the drawing, there is illustrated a pulse combustion system in which a single air intake assembly A is associated with a pair of pulse combustion gaseous fuel heater assemblies $B_1$ and $B_2$. The air intake assembly A includes a blower 11 connected to a pair of air chambers 13 through an air induction muffler 12. The heater assemblies $B_1$, $B_2$ each include a pulse combustion burner 21 mounted on a peripheral wall of a water tub or an oil vessel T and arranged within the respective air chambers 13. The pulse combustion burner 21 is connected to a gaseous fuel inlet pipe P through a gas chamber 21*a*, which burner 21 is equipped with flapper-type gas and air valves (not shown) for controlling the flow of gaseous fuel and air into the system. Furthermore, the heater assemblies $B_1$, $B_2$ each include a tailpipe 22 connected to the combustion chamber of burner 21, and an exhaust muffler 23 connected at its one end to the tailpipe 22 and at its other end to an exhaust pipe 24.

In operation of the system, the motor of blower 11 is energized under control of an electric control apparatus for the system to supply fresh air into the respective air chambers 13 through the air induction muffler 12, while the pulse combustion burners 21 are supplied with gaseous fuel under line pressure from the inlet pipes P through the gas chambers 21a under control of the electric control apparatus. Combustion is started in the respective pulse combustion burners 21 by supplying the fresh air through the air flapper valve and the gaseous fuel through the gas flapper valve. The air-gaseous fuel mixture is ignited by energization of each spark plug in the pulse combustion burners 21. This ignition creates a positive pressure in the respective combustion chambers of burners 21, closing the air and gas flapper valves. The combustion products exit through the respective tailpipes 22, exhaust mufflers 23 and exhaust pipes 24 due to the positive pressure wave. The ignition and combustion phase is followed by a contraction which produces a momentary negative pressure in the system, drawing in a fresh supply of gaseous fuel and combustion air through the flapper valves and also reversing the flow of combustion products at the respective open ends of exhaust pipes 24. The fresh charge automatically ignites, without the need for energization of the spark plugs, and the cycle repeats itself.

In this embodiment, the electric control apparatus is arranged to energize the motor of blower 11 for a predetermined period of time prior to selective activation of the heater assemblies B and is further arranged to energize the motor of blower 11 for the predetermined period of time when one of the heater assemblies $B_1$, $B_2$ is deactivated during activation of the other heater assembly $B_2$ or $B_1$. This is effective to purge exhaust gases from the deactivated heater assembly $B_1$ or $B_2$ thereby to eliminate a reverse flow of the exhaust gases from the deactivated heater assembly $B_1$ or $B_2$ into the activated heater assembly $B_2$ or $B_1$.

The electric control apparatus for the pulse combustion system comprises first and second control circuits which are connected to the motor of blower 11 through a common OR-gate G and a first driving circuit 30 and connected to the heater assemblies $B_1$ and $B_2$, respectively. The first control circuit includes an operation unit 31 provided with a power switch 31a for connection to an electric power source, a first indication lamp **31*b* connected to the power switch 31a for indication of power supply to the control circuit and a second indication lamp 31*c* for indication of an activated condition of the heater assembly $B_1$. The first control circuit further includes a sequence circuit 32 connected to the power switch 31a, first and second purge circuits 33, 34 connected at their input terminals to the sequence circuit 32 and at their output terminals to the OR gate G, a second driving circuit 35 connected at its input terminal to the sequence circuit 32 and at its output terminals to solenoid valves $V_1$, $V_2$, an igniter control circuit 36 connected at its input terminal to the sequence circuit 32 and at its output terminal to an igniter 37, a flame detector 38 connected at its input terminal to a flame sensor (not shown) in the combustion chamber of pulse combustion burner 21 and connected at its output terminal to the sequence circuit 32, and an indication circuit 39 connected at its input terminal to the sequence circuit 32 and at its output terminal to the second indication lamp 31*c* of the operation unit 31**.

In operation, the sequence circuit 32 produces a first output signal a therefrom when activated by closing of the power switch **31*a*, and the first purge circuit 33 produces an output signal therefrom in response to the first output signal a from sequence circuit 32. Thus, the first driving circuit 30 is applied with the output signal from first purge circuit 33 through the OR-gate G to produce a driving signal therefrom, and in turn, the motor of blower 11 is energized by the driving signal applied thereto from the driving circuit 30 and maintained in its energized condition. Subsequently, the sequence circuit 32 is applied with a time-up signal from the first purge circuit 33 after lapse of a first predetermined period of time to produce second and third output signals b and c therefrom, the second driving circuit 35 produces driving signals therefrom in response to the second output signal b from sequence circuit 32, and the igniter control circuit 36 produces an ignition signal therefrom in response to the third output signal c from sequence circuit 32 to maintain it for a second predetermined period of time. Thus, the solenoid valves $V_1$ and $V_2$ are energized by the driving signals from second driving circuit 35 to supply the gaseous fuel under line pressure into the gaseous fuel inlet pipe P, while the igniter 37 is activated by the ignition signal from igniter control circuit 36 to energize the spark plug in pulse combustion burner 21** for the second predetermined period of time.

Subsequently, the flame detector 38 detects combustion of the air-fuel mixture in the pulse combustion burner 21 to produce an output signal therefrom. When applied with the output signal from flame detector 38, the sequence circuit 32 produces a fourth output signal d therefrom to maintain it during activation of the pulse combustion burner 21, and in turn, the indication circuit 39 is applied with the fourth output signal d from sequence circuit 32 to produce an indication signal therefrom. Thus, the second indication lamp **31*c* of operation unit 31 is energized by the indication signal from circuit 39 to indicate the activated condition of the pulse combustion burner 21. Simultaneously, the sequence circuit 32 causes disappearance of the first and third output signals a and c to deactivate the first purge circuit 33 and the igniter control circuit 36, resulting in deenergization of the motor of blower 11 and the igniter 37**.

If the combustion of the air-fuel mixture may not be detected for the second perdetermined period of time, the flame detector 38 will not produce any output signal therefrom. In such a condition, the sequence circuit 32 is applied with a time-up signal from the igniter control circuit 36 after lapse of the second predetermined period of time to cause disappearance of the first, second and third output signals a, b and c thereby to deactivate the first purge circuit 33, the second driving circuit 15 and the igniter control circuit 36, resulting in deenergization of the motor of blower 11, the solenoid valves $V_1$, $V_2$ and the igniter 37. In this condition, the sequence circuit 32 does not produce the fourth output signal d, and also the indication circuit 39 does not produce any indication signal to maintain the second indication lamp 31c in its deenergized condition.

When the power switch **31*a* is opened during activation of the heater assembly $B_1$ to deenergize the indication lamp 31*b*, the sequence circuit 32 causes disappearance of the second output signal b to deactivate the second driving circuit 35 and produces a fifth output signal e therefrom. Thus, the solenoid valves $V_1$, $V_2$ are deenergized to block the supply of gaseous fuel to the inlet pipe P so as to deactivate the pulse combustion burner 21, while the second purge circuit 34 produces an output signal therefrom in response to the fifth output signal e from sequence circuit 32. Then, the first driving circuit 30 is applied with the output signal from the second purge circuit 34 through the OR-gate G to produce a driving signal therefrom, and in turn, the motor of blower 11 is energized by the driving signal applied thereto from the driving circuit 30 and maintained in its energized condition. Subsequently, the sequence circuit 32 is applied with a time-up signal from the second purge circuit 34 after lapse of a predetermined period of time to cause disappearance of the fifth output signal e. As a result, the second purge circuit 34 is deactivated to deenergize the first driving circuit 30, resulting in deenergization of the motor of blower 11**. This is effective to purge exhaust gases from the deactivated heater assembly $B_1$.

Similarly to the first control circuit for the heater assembly $B_1$, the second control circuit for the heater assembly $B_2$ includes an operation unit 41, a sequence circuit 42, first and second purge circuits 43, 44, a second driving circuit 45, an igniter control circuit 46, an igniter 47, a flame detector 48 and an indication circuit 49 which are substantially the same as those in the first control circuit. In operation, the heater assembly $B_2$ is activated under the control of the second control circuit substantially in the same manner as described as to the heater assembly $B_1$.

Assuming that during activation of both the heater assemblies $B_1$ and $B_2$, the power switch **31*a* is opened to deenergize the indication lamp 31*b*, the sequence circuit 32 causes disppearance of the second output signal b to deactivate the second driving circuit 35 and produces the fifth output signal e therefrom. As a result, the solenoid valves $V_1$, $V_2$ are deenergized to block the supply of gaseous fuel to the inlet pipe P so as to deactivate the heater assembly $B_1$, and the second purge circuit 34 is activated by the fifth output signal e from the sequence circuit 32 to energize the first driving circuit 30 in such a manner as described above. Thus, the motor of blower 11 is energized for the predetermined period of time to supply fresh air into the air chambers 13, 13** to purge exhuast gases from the deactivated heater assembly $B_1$. This is effective to eliminate a reverse flow of the exhaust gases from the deactivated heater assembly $B_1$ into the activated heater assembly $B_2$.

Although a specific embodiment of the present invention has been shown and described, it is obvious that many modifications thereof are possible. The invention, therefore, is not intended to be restricted to the exact showing of the drawing and description thereof, but is considered to include reasonable and obvious equivalents.

What is claimed is:

1. A pulse combustion system in which a single air intake assembly is associated with a plurality of pulse combustion gaseous fuel heater assemblies, said air intake assembly including a blower arranged to supply combustion air to said heater assemblies, and said heater assemblies each including a pulse combustion burner arranged to be supplied with gaseous fuel from a source of gaseous fuel and the combustion air from said burner, tailpipe means connected to a combustion chamber of said burner for heating a substance, and an electric control apparatus comprising means for selectively activating said heater assemblies, means for energizing a motor of said blower for a predetermined period of time prior to selective activation of said heater assemblies, and means for energizing the motor of said blower for a second predetermined period of time after one of said heater assemblies has been deactivated during activation of the other heater assemblies said means for selectively activating said heaters and said means for energizing said motor of said blower being controlled by circuit means responsive to flame in said combustion chamber.

2. A pulse combustion system as claimed in claim 1, wherein said electric control apparatus further comprises means for indicating selective activation of said heater assemblies in response to flame in said combustion chambers.

3. A pulse combustion system as claimed in claim 1, wherein said air intake assembly includes an air induction muffler interposed between said blower and said heater assemblies.

4. A pulse combustion system according to claim 1 wherein said means for energizing a motor of said blower for a predetermined period of time prior to selective activation of said heater assemblies comprises a first purge circuit means for activating a driving circuit means for energizing said blower, and said means for energizing the blower of said motor for a second predetermined period of time comprises a second purge circuit means for activating said driving circuit means.

5. A pulse combustion system according to claim 4 wherein said first purge circuit means and said second purge circuit means are connected to gate means having an output connected to said driving circuit means.

6. A pulse combustion system according to claim 5 wherein said means for selectively activating said heater assemblies, said means for energizing a motor of said blower for a predetermined period of time prior to selective activation of said heater assemblies, and said means for energizing the motor of said blower for a second predetermined period of time includes sequence circuit means for producing output signals to control said first and second purge circuit means.

* * * * *